US006969362B2

(12) United States Patent
Wang

(10) Patent No.: US 6,969,362 B2
(45) Date of Patent: Nov. 29, 2005

(54) DOUBLE FUNCTIONAL BATHING STRAP

(76) Inventor: Chieh-Min Wang, P.O. Box 697, Feng-Yuan City, Taichung Hsien (TW) 420

( * ) Notice: Subject to any disclaimer, the term of this patent is extended or adjusted under 35 U.S.C. 154(b) by 106 days.

(21) Appl. No.: 10/756,328

(22) Filed: Jan. 14, 2004

(65) Prior Publication Data

US 2005/0154335 A1 Jul. 14, 2005

(51) Int. Cl.[7] ..... A61H 199/00
(52) U.S. Cl. ..... 601/137; 601/138; 15/208
(58) Field of Search ..... 15/208, 222, 209.1, 15/210.1; 601/137–138, 143

(56) References Cited

U.S. PATENT DOCUMENTS 4,892,091 A * 1/1990 Sullenger ..... 601/137
5,545,456 A * 8/1996 Suida ..... 428/76
5,736,213 A * 4/1998 Meier ..... 428/76
5,787,541 A * 8/1998 Chen ..... 15/222
6,485,444 B1 * 11/2002 Gershov ..... 601/138
6,849,055 B1 * 2/2005 Williams ..... 601/137

* cited by examiner

*Primary Examiner*—Michael A. Brown

(57) ABSTRACT

A double functional bathing strap includes a number of inner flat section of uniform length and a pair of outmost flat sections having half length relative to the inner flat sections. The flat sections each has a plurality of conical studs regularly disposed on one side and a plurality of bristles regularly disposed on the other side, a first and a second coupling ends for combination of the flat sections together by a plurality of pairs of pairs of first and second locking pins, the pair of outmost flat sections each has a handle including a hook connected to their outer side via a triangular rib and a first coupling end or a second coupling end on inner side. So that the bathing strap is capable of scrubbing and/or massaging the body of a bather and length of the bathing strap is adjustable by addition or subtraction the number of the inner flat sections.

4 Claims, 6 Drawing Sheets

DOUBLE FUNCTIONAL BATHING STRAP

BACKGROUND OF THE INVENTION

The present invention relates to personal bathing articles and more particularly to a double functional bathing strap which is not only cleansing the body but also massages the body of a bather.

The bathing and cleansing articles have various kinds. Nowadays, people like to soak in hot spring or warm water to clean and massage their body at same time in order to advance in good heath for themselves. Previously, the applicant disclosed a massage hand gloves which has bristles on one side and studs on other side to facilitate the bathers to simultaneously clean and massage their bodies. Because this glove is made of soft material, it would not hurt their skin but activate their strength. So as to make them felt very comfortable. Thereforce, to make this glove become popularity. However, this glove can not reach to the back of the body and has to prepare varied sizes to fit the hands of men or women and adults or children that costs great deal of labor to make the mould during manufacturing stage. If adopts a strap type instead of the glove, its length has at least 90 centimeter and/or more than 100 centimeter for the westerners. But to make so large mould is very difficult.

SUMMARY OF THE PRESENT INVENTION

The present invention has a main object to provide a double functional bathing strap which is combined with a plurality of sections to make different length to fit the adults or children and is capable to clean or to massage the back, the neck, the belly, the buttocks and the legs of the human body. The result is very excellent.

Accordingly, the double functional bathing strap of the present invention comprises general a bathing strap which is combined with a number of flat sections. Each of the sections has bristles on one side and a plurality of studs on the other side and two connection ends, wherein the outmost section each has a connection end and a handle to facilitate the user to grasp the bathing strap with two hands. The number of sections may be more or less to combine a desired length in order to fit the adults or children.

The present invention will become more fully understood by reference to the following detailed description thereof when read in conjunction with the attached drawings.

DETAILED DESCRIPTION OF THE PREFERRED EMBODIMENT

Figure 1:
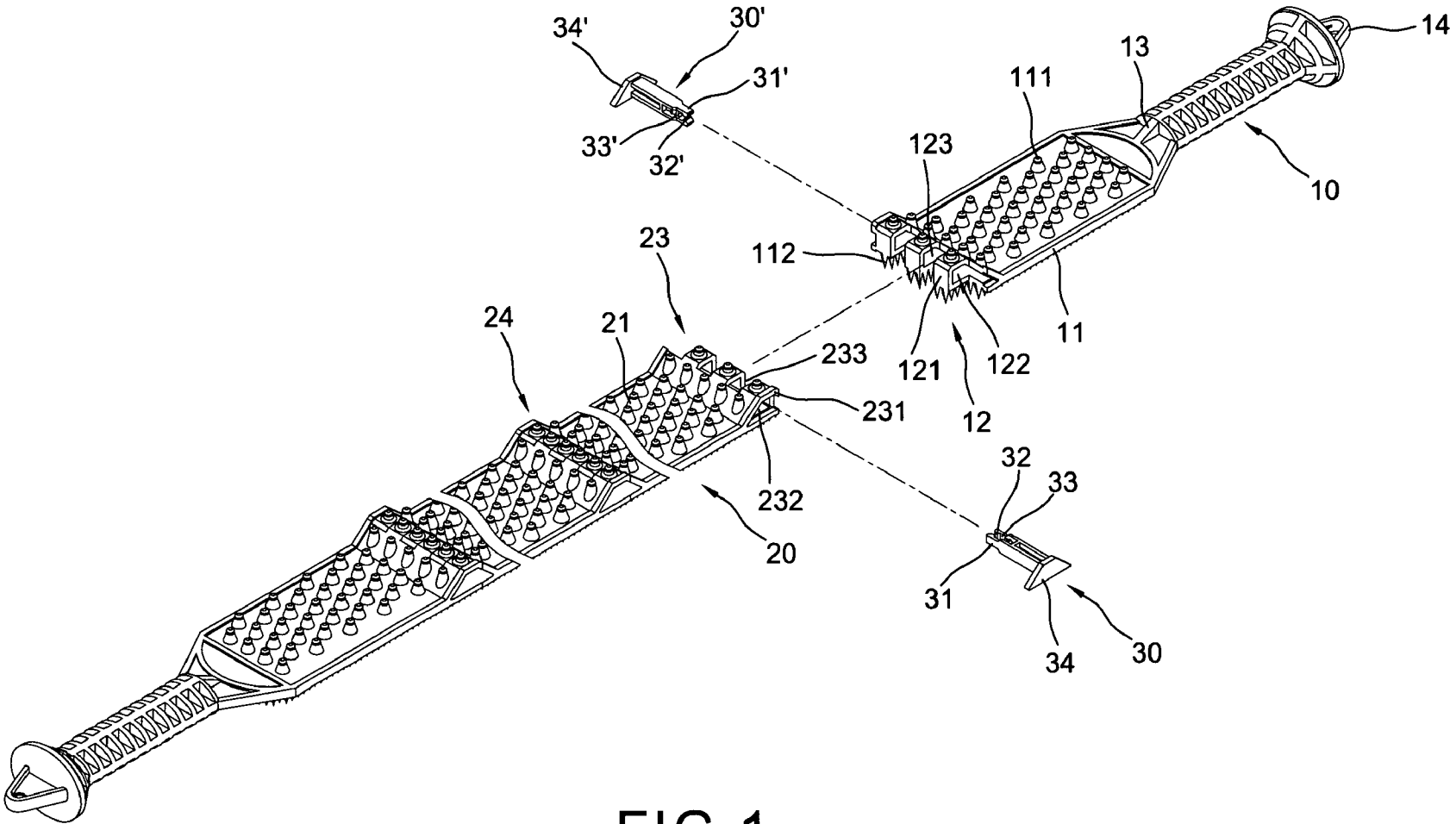
FIG. 1 is an exploded perspective view of the preferred embodiment of the bathing strap of the present invention.
Figure 2:
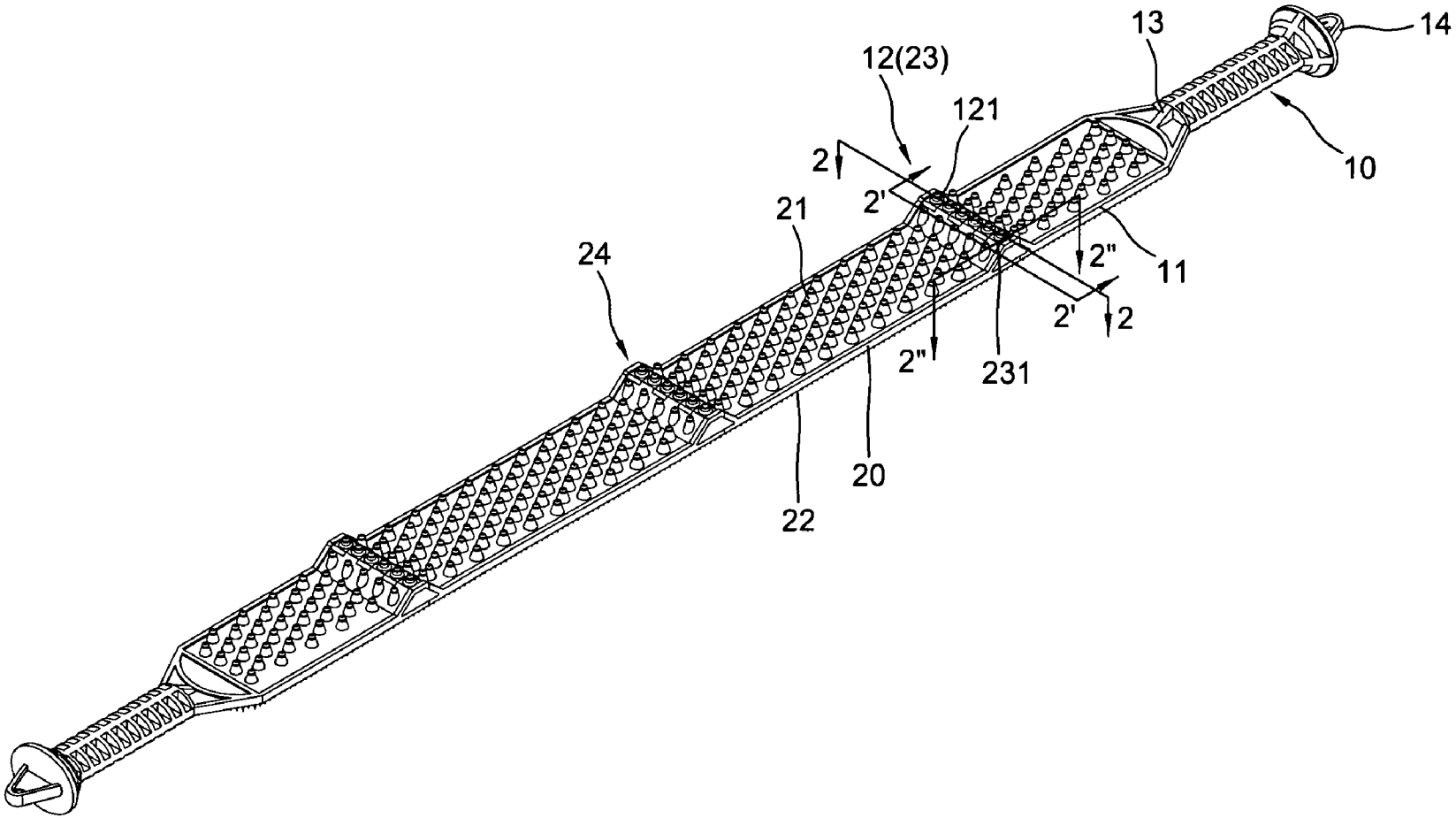
FIG. 2 is a perspective view of show the assembly of FIG. 1.
Figure 6:
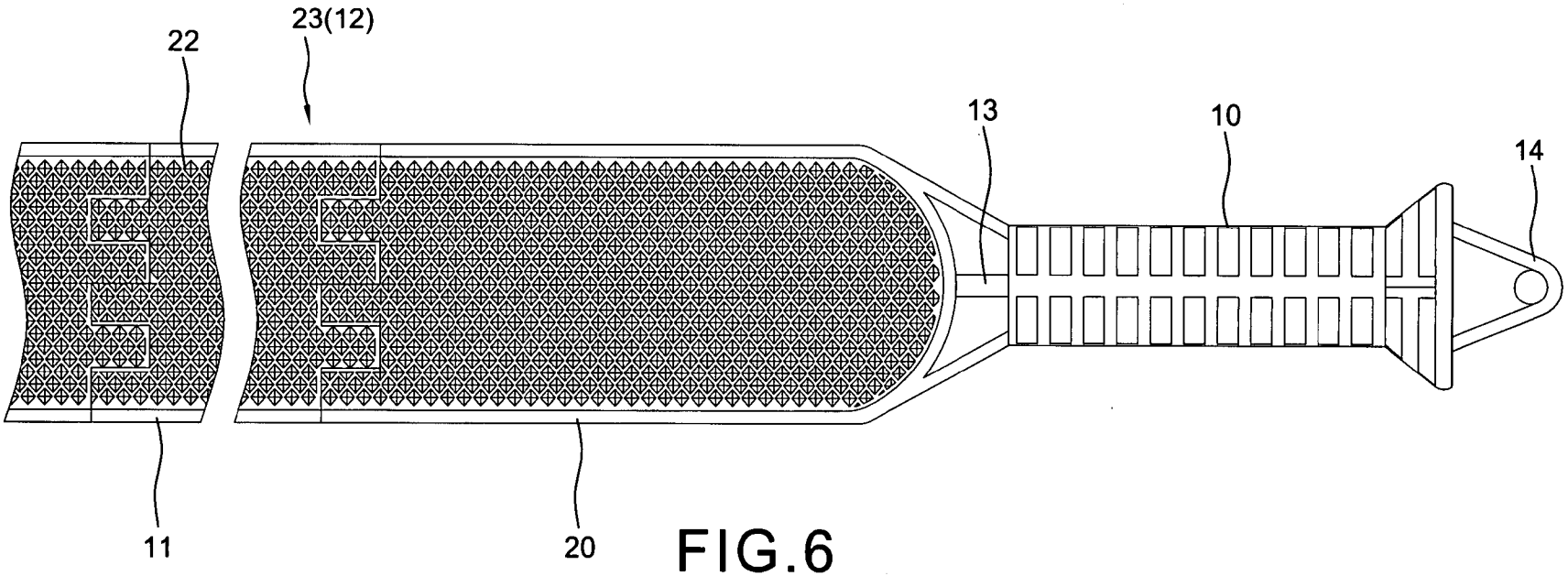
FIG. 6 is a plane view to show the bristles regularly disposed on one side of the bathing strap.

With reference to FIGS. 1, 2 and 6 of the drawings, the bathing strap comprises a number of inner flat sections 20 and a pair of handles 10 respectively connected to a pair of outmost half length flat sections 11 via a pair of triangular connection ribs 13 and a hook 14 on the free end of each of the handles 10 for suspending the bathing strap onto, a nail, a hook or an equivalent object. The outmost half length flat sections each has a plurality of conical studs 111 regularly disposed on one side and a plurality of bristles 112 on the other side and a coupling end 12 which includes three fasteners 121 to define three spaces 123 therebetween and each of the fasteners 121 has a horizontal trapezoid through hole 122.

Figure 3:
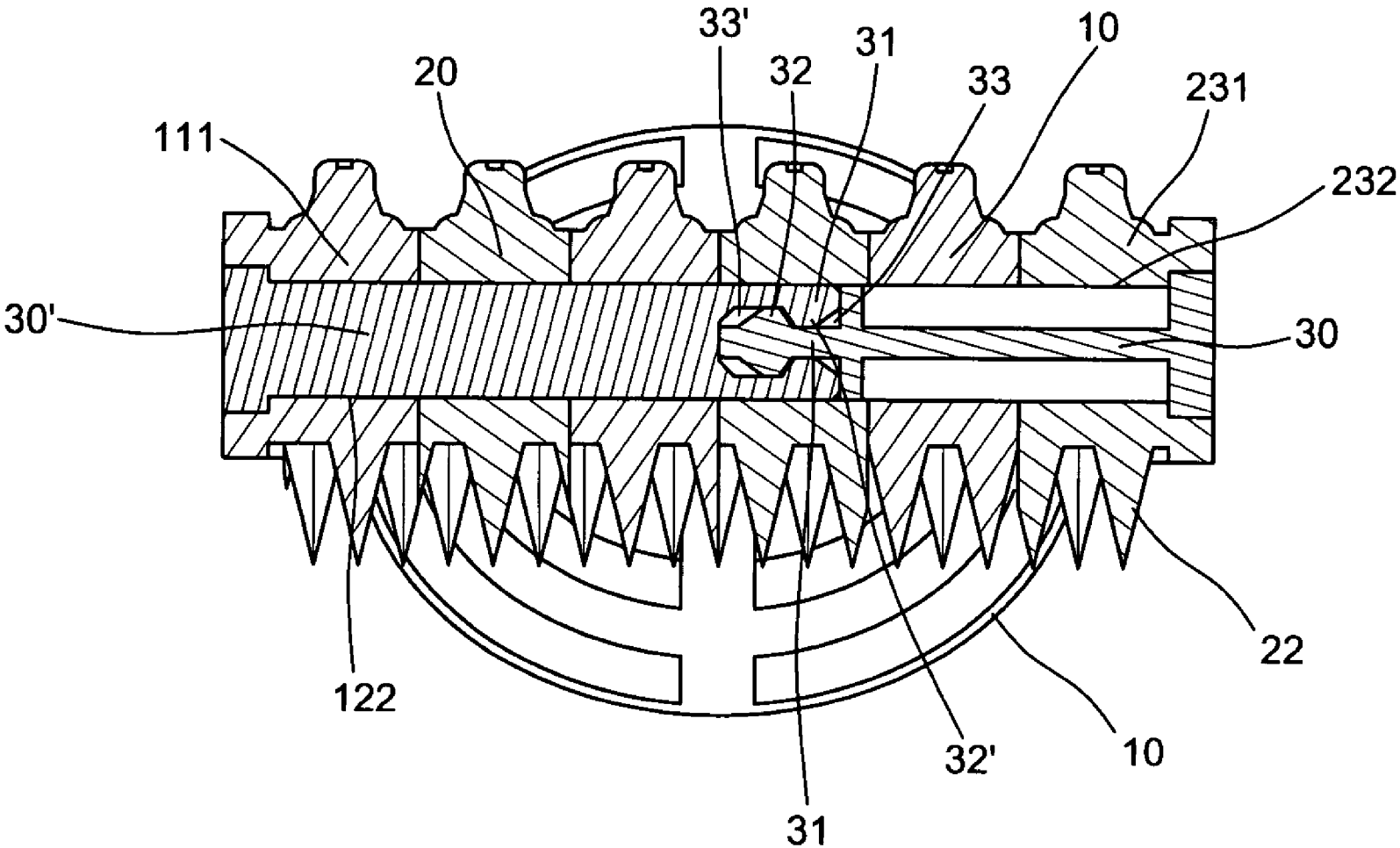
FIG. 3 is a sectional view of taken along line 2—2 of FIG. 2.

The flat strap is combined with a number of identical inner flat sections of uniform length, each of which has also a plurality of conical studs 21 regularly disposed on one side and a plurality of bristles 22 on the other side (as shown in FIG. 3), a first and a second coupling ends 23 and 24. The first coupling end 23 has also three fasteners 231 alternately formed relative to the three fasteners 121 of the coupling end 12 of the half length flat section 11 to define three spaces 233 therebetween. Each of the fasteners 231 has a horizontal trapezoid through hole 232 engageable with the through holes 122 of the fasteners 121. A pair of locking pins 30 and 30' each has a elastic grip 31 and 31', a pair of protrusions 32 and 32' on inner side of the grip 31 and 31' a receiving space 33 and 33' and a trapezoid plate 34 and 34' on outer end. However, the grip 31 of the locking pin 30 is horizontal and twisting 90° relative to the grip 31' of the locking pin 30'. The second coupling end each of the inner flat section 20 is structurally similar to the coupling end 12.

Figure 4:
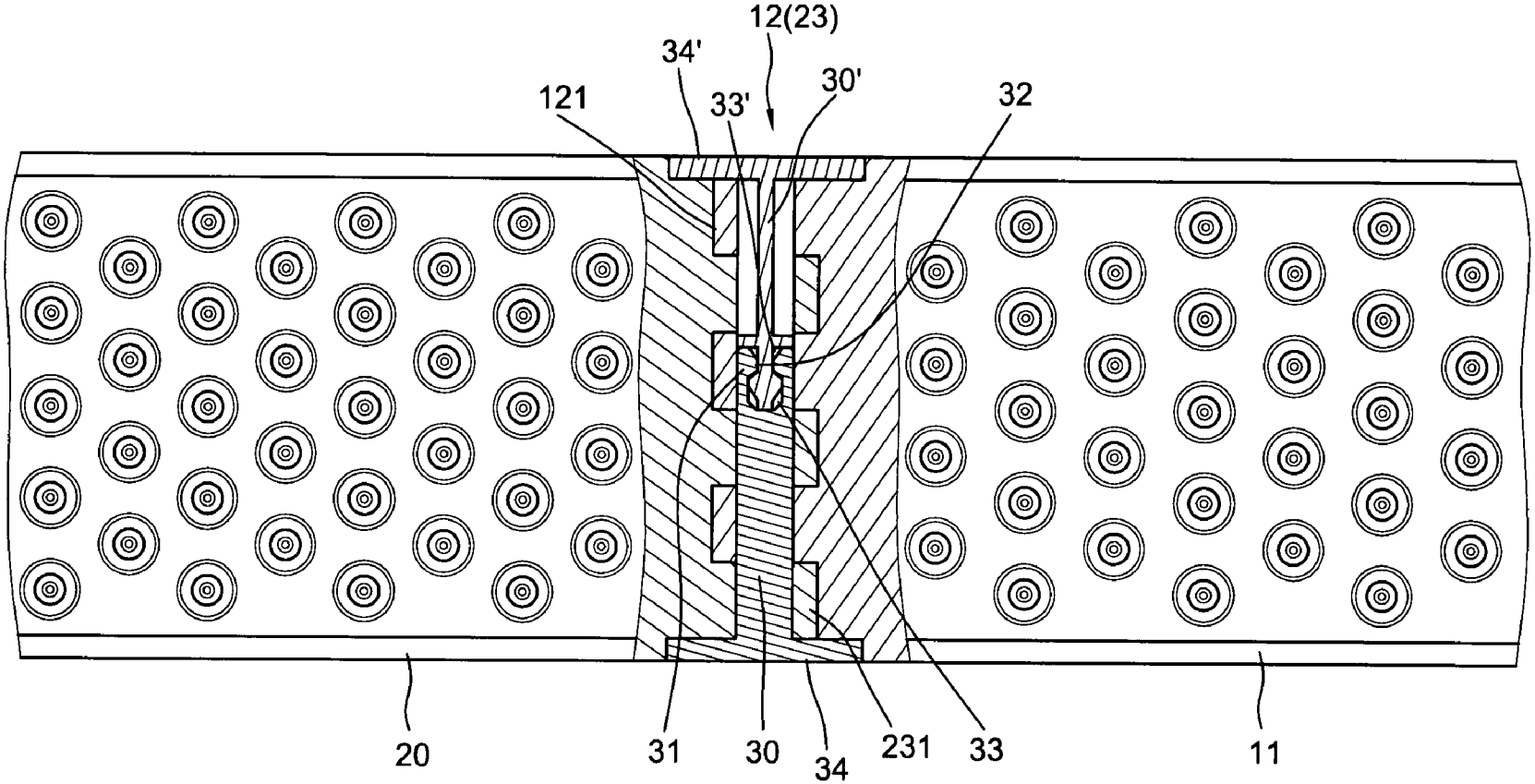
FIG. 4 is a sectional view taken along the line 2'—2' of FIG. 2.
Figure 5:
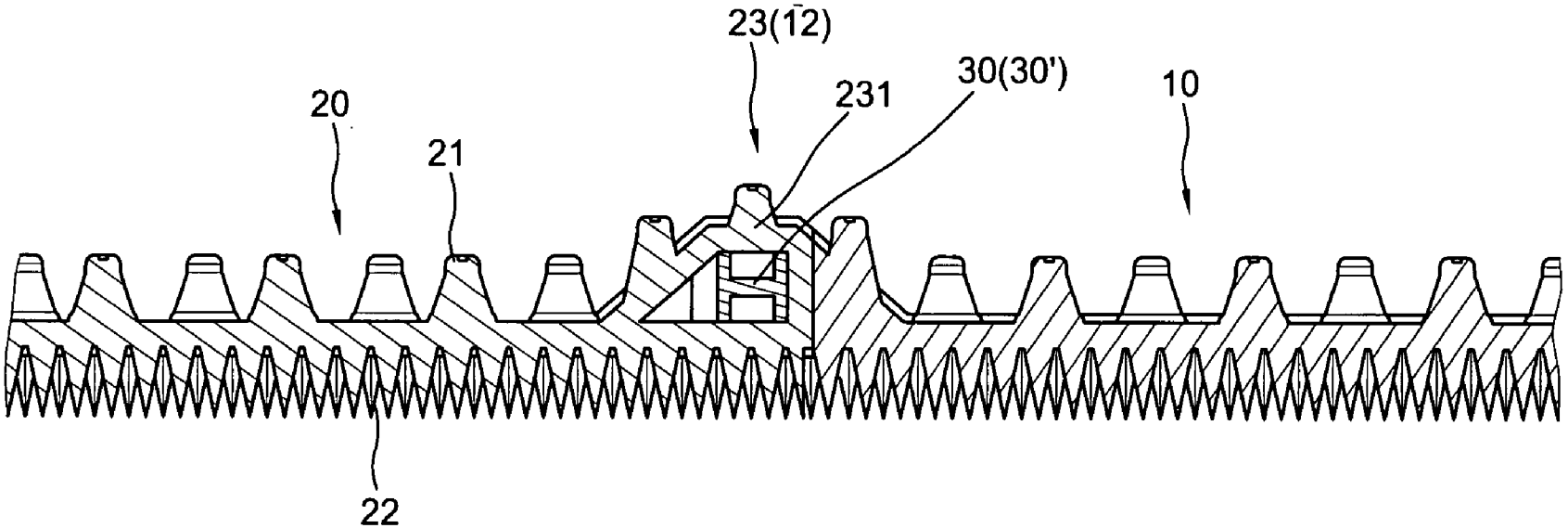
FIG. 5 is a sectional view taken along line 2"—2" of FIG. 2.

When coupling, engage the three fasteners 231 into the three spaces 123. On the contrary, engage the three fasteners 121 into the three spaces 233, then simultaneously insert the locking pins 30 and 30' from two sides of the flat sections into the horizontal trapezoid through holes 232 and 122 and press the trapezoid plates 34 and 34' so that the protrusions 32 of the locking pin 30 engage within the receiving space 33' of the locking pin 30'. Meanwhile, the protrusions 32' of the locking pin 30' engage within the receiving space 33 (as shown in FIGS. 3, 4 and 5). So that the outmost flat section 11 is connected with the inner flat section 20 of the bathing strap.

Since each of the inner sections 20 has a first coupling end and a second coupling end and the structure of there ends is identical to that has described in FIG. 1, so that the connection method is also the same as discussed the above. Normally, the length of a bathing strap for children includes a pair of the outmost flat sections in addition with inner flat section that is enough. For adults or westerners, the inner flat sections 20 can be added in number to make a desired length which may be 90 centimeter to 120 centimeter. Upon this improvement, the mould may be smaller and the injection range is shortened so as to lessen the flaws and the packing materials that reduces the cost for manufacturing.

The bathing strap of the present invention is made of soft material which will not hurt the skin of the bathers. That's why it is popularly used in SPA hydropathic treatment and soakage in hot spring. After being scrubbed and massaged by this bathing strap, people felt more comfortable than by the conventional cloth strap.

Note that the specification relating to the above embodiment should be construed as an exemplary rather than as a limitative of the present invention, with many variations and modifications being readily attainable by a person of average skill in the art without departing from the spirit or scope thereof as defined by the appended claims and their legal equivalents.

I claim:

1. A double functional bathing strap comprising:

a number of inner flat sections of identical length each having a first coupling end and a second coupling end engageable with each other, wherein said first and second coupling ends each having three fasteners alternately formed and defined three spaces therebetween and each of said fasteners having a trapezoid horizontal through hole, a plurality of conical studs regularly disposed on one side and a plurality of bristles regularly disposed on other side of said inner flat sections;

a pair of first and second outmost flat sections of half length in comparison with said inner flat sections, each having a handle with hook at distal end connected to outer end thereof via a triangular connection rib, a plurality of conical studs regularly disposed on one side and a plurality of bristles regularly disposed on other side, wherein said first outmost flat section having a second coupling end positioned apposite to said handle engageable with the first coupling end of said inner flat sections and said second outmost flat section having a first coupling end positioned opposite to said handle engageable the second coupling end of said inner flat sections;

a plurality of pairs of first and second locking pins for connecting the first coupling ends with the second coupling ends of said adjacent flat sections, wherein said first locking pin having a horizontal grip at front end inserted into the trapezoid through holes of said first and second coupling ends from a lateral side of said flat sections, a pair of protrusion symmetrically disposed on inner sides of said grip, a receiving space in an inner side of said grip and a trapezoid plate on outer end thereof engaged within a outmost trapezoid horizontal through hole and said second locking pin having a vertical grip at front end twisting 90° relative to the horizontal grip of said first locking pin, a pair of protrusions symmetrically disposed on inner sides of said grip, a receiving space in an inner side of said grip and a trapezoid plate on outer end thereof;

whereby, insert said second locking pin from other lateral side of said flat sections into said trapezoid horizontal through holes of said first and second coupling ends, said vertical grip, will be automatically engaged within said horizontal grip, their protrusions will be mutually engaged within their receiving spaces and the trapezoid plate of said second locking pin engages within an outmost trapezoid horizontal through holes of said other lateral side.

2. The double functional bathing strap as recited in claim 1, wherein said bathing strap is made of soft material.

3. The double functional bathing strap as recited in claim 1, wherein said bathing strap is lengthily adjustable by addition or subtraction of the number of said inner flat sections.

4. The double functional bathing strap as recited in claim 1, wherein said bathing strap is capable of scrubbing and massaging the body of a bather.

* * * * *